US009370208B2

(12) United States Patent
Behrend et al.

(10) Patent No.: US 9,370,208 B2
(45) Date of Patent: Jun. 21, 2016

(54) PROTECTIVE APPARATUS WITH A VARIED THICKNESS LATTICE SUPPORT STRUCTURE

(71) Applicant: Nike, Inc., Beaverton, OR (US)

(72) Inventors: Carl Behrend, Portland, OR (US); Oliver McLachlan, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 258 days.

(21) Appl. No.: 13/804,758

(22) Filed: Mar. 14, 2013

(65) Prior Publication Data

US 2014/0259325 A1 Sep. 18, 2014

(51) Int. Cl.

| | |
|---|---|
| ***A41D 13/06*** | (2006.01) |
| ***A63B 71/06*** | (2006.01) |
| ***A41D 13/015*** | (2006.01) |
| *A63B 71/00* | (2006.01) |

(52) U.S. Cl.

CPC ..... *A41D 13/06* (2013.01); *A41D 13/015* (2013.01); *A63B 2071/0063* (2013.01)

(58) Field of Classification Search

CPC ... A41D 13/05; A41D 13/015; A41D 13/153; A41D 13/0543; A41D 13/065; A63B 2071/0063; A63B 71/0054

USPC ..... 2/22

See application file for complete search history.

(56) References Cited

U.S. PATENT DOCUMENTS

| | | | | |
|---|---|---|---|---|
| 4,354,280 | A * | 10/1982 | Hayes | 2/16 |
| 4,484,360 | A * | 11/1984 | Leighton et al. | 2/22 |
| 5,581,805 | A * | 12/1996 | Rennick | 2/455 |
| 5,924,140 | A * | 7/1999 | Chi | 2/455 |
| 6,065,152 | A * | 5/2000 | Parker | 2/22 |
| 6,105,164 | A * | 8/2000 | Huang | 2/22 |
| 6,151,714 | A | 11/2000 | Pratt | |
| 6,161,222 | A * | 12/2000 | Strickland et al. | 2/228 |
| 6,519,781 | B1 * | 2/2003 | Berns | 2/267 |
| 6,969,548 | B1 | 11/2005 | Goldfine | |
| 2003/0088900 | A1 * | 5/2003 | Cho | 2/22 |
| 2006/0096000 | A1 * | 5/2006 | Romero et al. | 2/22 |
| 2006/0179538 | A1 * | 8/2006 | Dodd | 2/22 |
| 2006/0277644 | A1 * | 12/2006 | Dobkin | 2/24 |
| 2008/0189822 | A1 * | 8/2008 | Johannessen et al. | 2/22 |
| 2009/0070911 | A1 * | 3/2009 | Chang | 2/24 |

(Continued)

OTHER PUBLICATIONS

International Search Report with Written Opinion dated Jul. 1, 2014 in PCT/US2014/021903, 13 pages.

(Continued)

*Primary Examiner* — Anna Kinsaul
*Assistant Examiner* — Jocelyn Wu
(74) *Attorney, Agent, or Firm* — Shook, Hardy & Bacon L.L.P.

(57) ABSTRACT

Aspects of the present invention relate to a protective apparatus that is comprised of an impact shell and an impact attenuating component. In particular, the impact shell is comprised of a lattice structure on the posterior side of the shell that protrudes from the shell and allows the impact attenuating structure to be offset or spaced from the posterior surface of the shell in at least a middle portion of the shell. The amount of protrusion of the lattice from the posterior surface of the shell reduces as the lattice extends from a middle portion of the shell outwardly towards a medial and/or lateral portion. The lattice structure provides improved impact attenuation characteristics and increased structural strength while reducing materials.

18 Claims, 3 Drawing Sheets

(56) References Cited

U.S. PATENT DOCUMENTS

| | | | | |
|---|---|---|---|---|
| 2010/0205724 | A1* | 8/2010 | Kamradt | 2/459 |
| 2011/0113559 | A1* | 5/2011 | Dodd | 5/690 |
| 2012/0030850 | A1 | 2/2012 | Wood | |
| 2012/0084896 | A1* | 4/2012 | Wyner et al. | 2/16 |
| 2012/0180183 | A1* | 7/2012 | Mechling et al. | 2/22 |
| 2012/0272426 | A1* | 11/2012 | Dodd | 2/22 |
| 2013/0232674 | A1* | 9/2013 | Behrend et al. | 2/455 |
| 2013/0234376 | A1* | 9/2013 | Frey et al. | 267/141 |

OTHER PUBLICATIONS

International Preliminary Report on Patentability dated Sep. 24, 2015 in Application No. PCT/US2014/021903, 8 pages.

* cited by examiner

PROTECTIVE APPARATUS WITH A VARIED THICKNESS LATTICE SUPPORT STRUCTURE

BACKGROUND

A protective apparatus is traditionally used to limit an impact force experienced by a person or an object. A protective apparatus dissipates and attenuates an impact force as well as resists a puncture or impalement. Consequently, a protective apparatus, such as a shin guard, utilizes an exterior impact shell in combination with an impact attenuating structure, such as foam padding. The impact shell is generally formed from a rigid material that is resistant to punctures and impalements and is also capable of distributing an impact force across a larger area of the impact attenuating structure.

SUMMARY

Aspects of the present invention relate to a protective apparatus that is comprised of an impact shell and an impact attenuating component. In particular, the impact shell is comprised of a lattice structure on the posterior side of the shell that protrudes from the shell and allows the impact attenuating structure to be offset or spaced from the posterior surface of the shell in at least a middle portion of the shell. The amount of protrusion of the lattice from the posterior surface of the shell reduces as the lattice extends from a middle portion of the shell outwardly towards a medial and/or lateral portion. The lattice structure provides improved impact attenuation characteristics and increased structural strength while reducing materials.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION

Figure 1:
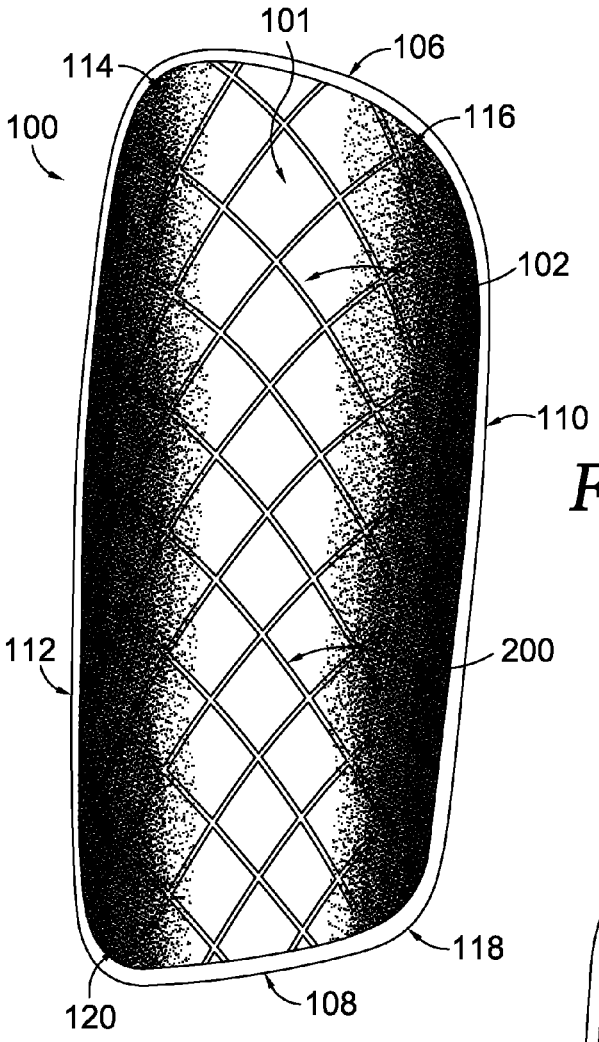
FIG. 1 illustrates an anterior view of an exemplary protective apparatus, in accordance with aspects of the present invention.

The subject matter of embodiments of the present invention is described with specificity herein to meet statutory requirements. However, the description itself is not intended to limit the scope of this patent. Rather, the inventors have contemplated that the claimed subject matter might also be embodied in other ways, to include different elements or combinations of elements similar to the ones described in this document, in conjunction with other present or future technologies.

Embodiments of the present invention relate to a protective apparatus that is comprised of an impact shell and an impact attenuating structure. In particular, the impact shell is comprised of a lattice structure on the posterior side of the shell that protrudes from the shell and allows the impact attenuating structure to be offset or spaced from the posterior surface of the shell in at least a middle portion of the shell. The amount of protrusion of the lattice from the posterior surface of the shell reduces as the lattice extends from a middle portion of the shell outwardly towards a medial and/or lateral portion. The lattice structure provides improved impact attenuation characteristics and increased structural strength while reducing materials.

Accordingly, in one aspect, the present invention provides a protective apparatus comprising an impact shell having an anterior surface, an opposite posterior surface, a medial edge, an opposite lateral edge, a superior edge, and an opposite inferior edge. The impact shell also includes an integrally formed structural lattice protruding from the impact shell posterior surface forming a protrusion surface. The lattice has a medial portion, a middle portion, and a lateral portion that correspond with a medial, middle, and lateral portion of the shell respectively. The lattice protrudes from the impact shell posterior surface a first amount within the medial portion and a second amount within the middle portion. In this example, the first amount is less than the second amount. Additionally, the protective apparatus is comprised of an impact attenuating structure positioned proximate the posterior surface of the impact shell and the protrusion surface of the lattice. The impact attenuating structure is affixed to the impact shell at least near the medial edge and the lateral edge.

In another aspect, the present invention provides a protective apparatus comprising an impact shell having an anterior surface, an opposite posterior surface, a medial edge, an opposite lateral edge, a superior edge, and an opposite inferior edge. The posterior surface of the impact shell has a first curved profile extending outwardly in a direction of the anterior surface from the medial edge to the lateral edge. The first curved profile has a first diameter. The protective apparatus is further comprised of a structural lattice integrally formed with the impact shell and protruding from the posterior surface of the impact shell. The structural lattice is comprised of a plurality of interconnected rib members protruding from the posterior surface in a direction opposite from the anterior surface. The plurality of interconnected rib members form a protrusion surface. The protrusion surface has a second curved profile extending outwardly in a direction of the impact shell anterior surface from the impact shell medial edge toward the impact shell lateral edge. The second curved profile has a second diameter. The second diameter is greater than the first diameter. The protective apparatus is further comprised of an impact attenuating structure positioned near the posterior surface of the impact shell and the protrusion surface of the lattice.

A third aspect of the present invention also provides a protective apparatus comprising an impact shell having an anterior surface, an opposite posterior surface. The posterior surface curved toward the anterior surface between a medial edge and an opposite lateral edge. The protective apparatus is further comprised of a structural lattice that protrudes from the impact shell posterior surface, which forms a protrusion surface. The protrusion surface protrudes from the impact shell posterior surface a greater amount in a middle portion of the structural lattice than in a medial portion of the structural lattice and a lateral portion of the structural lattice. The protective apparatus is further comprised of an impact attenuating structure that is positioned near the posterior surface of the impact shell and the protrusion surface of the lattice. The impact attenuating structure has an anterior surface near the posterior surface of the impact shell and the protrusion surface of the lattice. A portion of the impact attenuating structure is offset from the posterior surface of the impact shell by the structural lattice.

Having briefly described an overview of embodiments of the present invention, a more detailed description follows.

The protective apparatus is contemplated as providing protection to one or more portions of a body or object. For example, it is contemplated that a protective apparatus implementing one or more aspects provided herein may be utilized to provide protection and/or force damping functions to a variety of body parts. Examples include, but are not limited to, shin guards, knee pads, hip pads, abdominal pads, chest pads, shoulder pads, arm pads, and elbow pads, for example. Therefore, it is contemplated that aspects provided herein may be useful in a variety of situations at a variety of locations.

A protective apparatus, as provided herein, is an article for reducing an effect of an impact force on an associated portion of a wearer. For example, a shin guard utilizing features discussed herein may reduce the perception of energy imparted on the shin region of a user through the use of the protective apparatus. This change in perception may be accomplished in a variety of ways. For example, the energy applied at a point of impact may be distributed over a greater surface area, such as through a rigid impact shell. Further, it is contemplated that a dissipating/absorbing material may provide a compressive function for absorbing and/or dissipating a portion of the impact force.

FIG. 1 illustrates an anterior view of an exemplary protective apparatus 100 in accordance with aspects of the present invention. In this illustration, the protective apparatus is a shin guard intended to protect the tibia bone of a wearer and the calf region surrounding the shin from an impact force. As can be appreciated by one of skill in the art, a shin guard may be produced in a right-leg orientation and a left-leg orientation. Therefore, while one or more orientations are depicted, it is contemplated that concepts similar to those discussed and depicted may be translated to the opposite orientation. Stated differently, while a right shin guard may be discussed herein, it is contemplated that a left shin guard having a mirror-image orientation is also contemplated. Further, human anatomical relational terms are used herein (e.g., medial, lateral, superior, inferior, posterior, and anterior) as general locational terms for reference. However, it is contemplated that alternative aspects may be implemented that are contrary to the terms meaning with respect to a human body. Stated differently, a medial edge of a protective apparatus is contemplated, in an exemplary aspect, of being located proximate a lateral relative location on the wearer, for example.

The protective apparatus 100 is comprised of an impact shell 101 (also called a "shell" hereinafter) and an impact attenuating structure (not depicted). The shell 101 is comprised of a perimeter that may be defined, in part, by a superior edge 106, an opposite inferior edge 108, a medial edge 110, and an opposite lateral edge 112. Based on the general edge locations, regions of the protective apparatus may be defined, such as a superior lateral portion 114, a superior medial portion 116, an inferior medial portion 118, and an inferior lateral portion 120. Each of these portions refers to a general location and are not specific points on the protective apparatus 100. As will be discussed later, elements of a structural lattice 200 (hereinafter referred to as a "lattice") may be described as extending from the general direction of one or more of these regions to one or more alternative regions.

As is typical for a shin guard, the protective apparatus 100 has a general curve defined as extending from a posterior surface (e.g., closest to the wearer when in an as-worn position) in the direction of an anterior surface 102. Stated differently, the protective apparatus generally curves such that the center (e.g., origin) of the curve is on the posterior side rather than the anterior side. Consequently, the protective apparatus is able to wrap around a portion of a wearer's leg when in an as-worn position.

The shell 101, in an exemplary aspect, is formed from a rigid or semi-rigid material that is effective to distribute an impact force across an area of the protective apparatus. Further, the shell 101 is formed from a material that is functional to resist a puncture force exerted by an object, such as an opposing athlete's shoe cleat(s). Therefore, the shell 101 is manufactured from a material that is resilient enough to withstand an impact force and also able to deflect a potential impalement. Materials contemplated for manufacturing the shell 101 include, but are not limited to, a polypropylene material, a styrene-butadiene copolymer material, a carbon fiber-based material, other polymer-based materials, metallic materials, laminates, and other materials commonly utilized in the manufacture of a protective apparatus. In an exemplary aspect, a styrene-butadiene copolymer material may be utilized to provide a transparent shell that allows a wearer to detect wear and damage to the shell and the anterior surface of the impact attenuating structure without requiring a disassembly of the protective apparatus. Further, it is contemplated that a transparent shell also allows for verification of proper alignment of the shell and the impact attenuating structure at the time of coupling. As will be discussed later, it is contemplated that an alignment of one or more channels of the impact attenuating structure may occur with the ribs of the lattice on the shell, which may be visibly aligned with a transparent shell, in an exemplary aspect.

However, as will be discussed hereinafter, a portion of a transparent shell may be masked to obscure materials on the posterior side of the shell. For example, an adhesive used to couple the shell and the impact attenuating structure may be obscured by a graphical element, such as a colorant, paint, dye, laminate, decal, and the like that is applied to the shell. An exemplary masking/obscuring of a portion of an otherwise transparent shell is depicted in FIG. 1, such that a gradient or other obscuring pattern may be implemented that extends from the medial and lateral sides toward the interior/middle of the shell, as will be discussed in greater detail with respect to FIG. 3 hereinafter.

Figure 2:
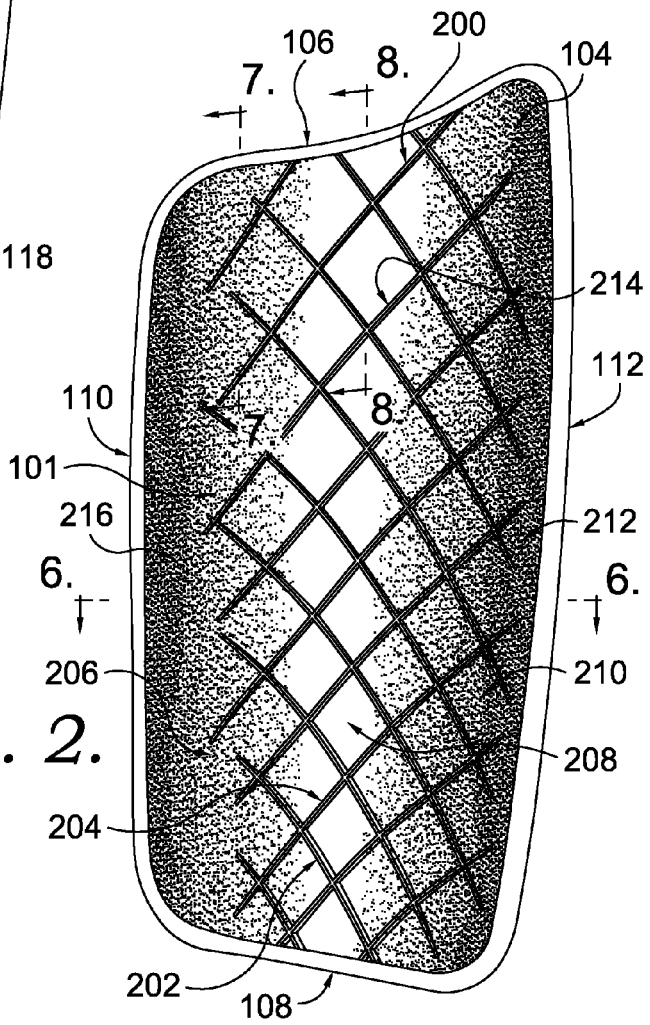
FIG. 2 illustrates a posterior perspective of a shell that exposes a posterior surface of a shell, in accordance with an aspect of the present invention.

FIG. 2 illustrates a posterior perspective of the shell 101 that exposes a posterior surface 104 of the shell 101, in accordance with an aspect of the present invention. As previously provided in the FIG. 1, the shell 101 is comprised of the superior edge 106, the inferior edge 108, the lateral edge 112, and the medial edge 110.

Further, the shell 101 is comprised of the lattice 200. As depicted, the lattice 200 extends/protrudes from the shell posterior surface 104. The surface formed from the protruding lattice 200 is referred to as the protrusion surface. In an exemplary aspect, the protrusion surface contacts an anterior surface of the impact attenuating structure, which offsets (e.g., spaces apart) the anterior surface of the impact attenuating structure from the posterior surface 104 of the shell 101. Consequently, the impact attenuating structure may contact the posterior surface 104 in locations where the lattice 200 fails to protrude a sufficient amount from the posterior surface 104.

The lattice 200 is comprised of a plurality of ribs (e.g., elements), such as a first rib 202 and a second rib 204. The first rib 202 may generally be described as extending from the inferior lateral direction towards the superior medial direction. The second rib 204 may generally be described as extending from the inferior medial direction towards the superior lateral direction. While a specific orientation and arrangement is depicted, it is contemplated that any size, shape, and orientation of ribs may be implemented in any combination to form a lattice that provides structural support for the shell and/or an offset between the shell posterior surface and the impact attenuating anterior surface. In an exemplary aspect, a first rib element and a second rib element intersect to form a portion of a lattice. It is contemplated that at the point of intersection, both the first rib element and the second rib element protrude an equal amount (e.g., create a similar offset) from the posterior surface.

The formation of the lattice 200 is contemplated as occurring during the manufacturing of the shell 101. For example, the lattice 200, in an exemplary aspect, is concurrently formed with the shell 101 in a common manufacturing process, such as molding (e.g., injection, compression, and the like) and additive manufacturing techniques (e.g., sintering, deposit). Therefore, the lattice 200 may be a mere feature of a uniform part that also forms the shell 101. Consequently, it is contemplated that the lattice 200 and the shell 101 are formed from a common material in a common manufacturing operation at the same time, in an exemplary aspect.

The shell 101 is comprised of several general regions identified as a medial portion 206, a middle portion 208, and a lateral portion 210. In an exemplary aspect, each of these regions/portions of the shell 101 may extend from the superior edge 106 to the inferior edge 108. Further, in an exemplary aspect, it is contemplated that the lattice 200 extends from the middle portion 208 outwardly in the medial-lateral direction to locations within the medial portion 206 and the lateral portion 210. The lattice 200 then terminates within the medial portion 206 and the lateral portion 210. The termination of the lattice may result based on the convergence of the protrusion surface 214 and the posterior surface 104 as the protrusion surface 214 descends into the posterior surface 104. As will be discussed in greater detail with FIGS. 6-8, a curve of the posterior surface 104 may be different (or have a different focal point) than that of a curve of the protrusion surface 214. This discrepancy in the curves defining the two surfaces, in an exemplary aspect, causes the lattice 200 to merge into the shell 101 as the lattice 200 extends laterally/medially from the middle portion 208. In an exemplary aspect, it is contemplated that the lattice 200 extends closer to the medial edge of the shell than the lateral edge of the shell before merging into the posterior surface to favor a tibia protecting area of the protection apparatus.

As will be discussed hereinafter with respect to FIG. 5, it is contemplated that the protective apparatus may be comprised of a medial affixing portion 216 and a lateral affixing portion 212. The affixing portions provide a location along the shell 101 posterior surface 104 in which the lattice 200 does not protrude from the posterior surface 104. The affixing portions 216 and 212, in an exemplary aspect, provides a location for coupling an impact attenuating structure to the shell 101.

FIG. 2 includes a cutline 6-6 extending horizontally from a medial to a lateral side of the shell 101. The cutline 6-6 is a reference line for the aspects illustrated in the cross-sectional view of FIG. 6 hereinafter. FIG. 2 also includes a cutline 7-7 extending in a vertical orientation within the medial portion 206. The cutline 7-7 is a reference line for the aspects illustrated in the cross-sectional view of FIG. 7 hereinafter. Additionally, FIG. 2 includes a cutline 8-8 extending in a vertical orientation within the middle portion 208. The cutline 8-8 is a reference line for the aspects illustrated in the cross-sectional view of FIG. 8 hereinafter.

Figure 3:
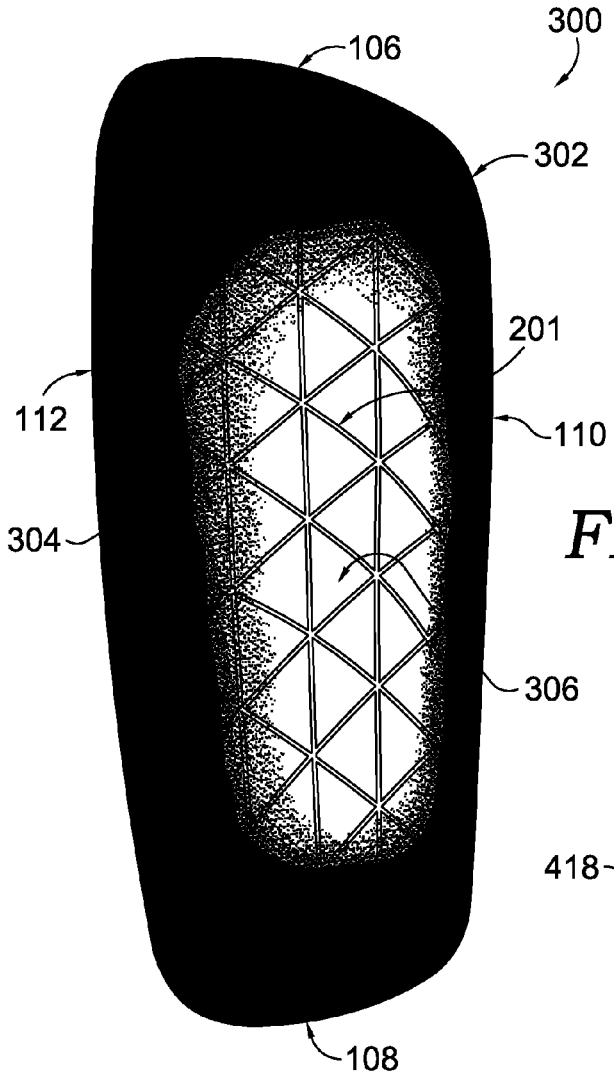
FIG. 3 depicts an anterior perspective of a partially obscured exemplary shell, in accordance with aspects of the present invention.

FIG. 3 depicts an anterior perspective of a partially obscured exemplary shell 300, in accordance with aspects of the present invention. The shell 300 is comprised of a superior edge 106, an inferior edge 108, a medial edge 110, and a lateral edge 112. Additionally, a lattice 201 is visible through a transparent portion 306. The lattice 201 protrudes in the posterior direction from the posterior surface of the shell 300.

As previously discussed, the shell 300 may be formed from a material that provides rigidity and resilience to deflect and disperse impact forces while still allowing for a transparency in portions, for reasons previously identified. However, because at least some of the bonding/coupling mechanisms that may be utilized (e.g., adhesives) to couple the shell 300 to an impact attenuating structure may be aesthetically unappealing as perceived through a transparent shell, a portion of the shell to which the coupling mechanism is utilized may be obscured or partially obscured. Further, ultraviolet energy that is able to pass through a transparent shell may have a detrimental effect on the bond created by a coupling mechanism. Therefore, to reduce the impact that radiation (e.g., sunlight) has on adhesives and other coupling mechanisms that may be affected by sunlight exposure, the portions of the shell that are utilized in the coupling process may be obscured or partially obscure to limit the effect of the light.

The shell 300 is depicted as having the transparent portion 306, an obscured portion 302, and a transition portion 304. The obscured portion 302 is depicted as emanating from the perimeter of the shell 300 inwardly toward a central region. It is contemplated that the obscured portion 302 corresponds with location in which the shell is coupled/affixed with an impact attenuating structure, at least in part. The transition portion 304 is a gradient of the applied masking material to transition into the transparent portion 306. The transition portion 304 may be utilized to partially filter a radiation source and/or to provide an aesthetically pleasing transition from the obscured to transparent portions.

While the term "obscured" is used, it is understood that any reduction in transmission of light relative to the transparent portion 306 is contemplated as being an "obscured" portion. Further, while a combination of the transparent portion 306, the transition portion 304, and the obscured portion 302 is depicted, it is contemplated that any combination or any portion individually may be implemented in any location in exemplary aspects.

Figure 4:
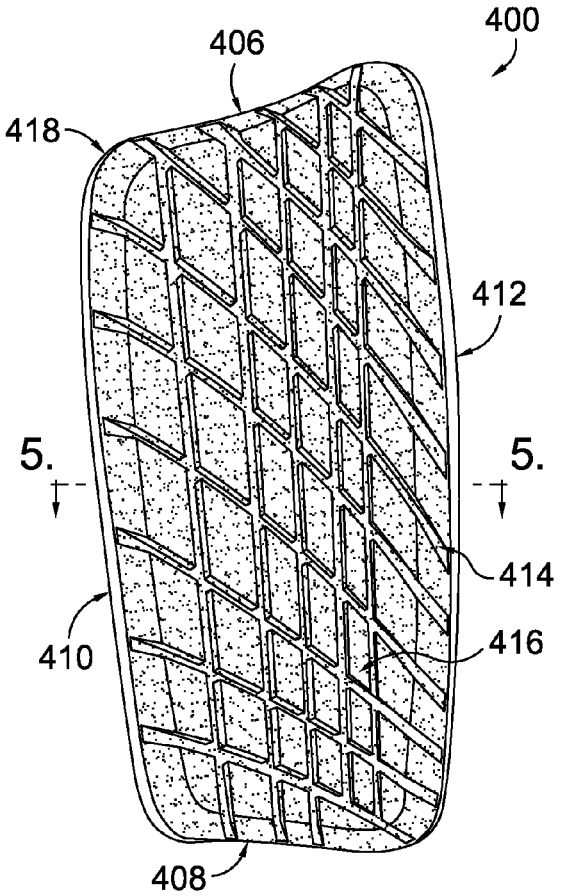
FIG. 4 illustrates a posterior perspective of an exemplary impact attenuating structure, in accordance with aspects of the present invention.

FIG. 4 illustrates a posterior perspective of an exemplary impact attenuating structure 400 in accordance with aspects of the present invention. The impact attenuating structure 400 is comprised of a superior edge 406, an opposite inferior edge 408, a medial edge 410, and an opposite lateral edge 412. A posterior surface 416 of the impact attenuating structure 400 is illustrated. A plurality of channels 414 are recessed from the posterior surface 416. The channels 414 may be arranged at any location, at any depth, of any length, of any shape, and of any combination. While not visible in FIG. 4, but will be discussed with respect to FIG. 5 hereinafter, a shell is coupled to an anterior surface 418 of the impact attenuating structure 400.

However, in an exemplary aspect, it is contemplated that one or more channels on the posterior side of the impact attenuating structure 400 align with one or more corresponding ribs of a lattice on a posterior side of a shell. As a result, it is contemplated that as an impact force is experienced on an anterior surface of a shell, the force is transferred through the shell and the lattice to the impact attenuating structure 400. Because the lattice creates an offset between the impact attenuating structure 400 and the shell posterior surface, the translation of the force by the shell to the impact attenuating structure 400 may be concentrated at the locations at which the protrusion surface of the lattice contacts the impact attenuating structure 400. As such, it is contemplated that the one or more channels of the impact attenuating structure 400 that correspond to the lattice provide a deflection area allowing the impact attenuating structure 400 to deform at the channels to absorb at least a portion of the force before transferring the force through (and absorbing at least a portion of the force by) the impact attenuating structure 400. Stated differently, the channels may provide a natural deformation feature that distributes the concentrated force applied by the lattice across a greater area of the impact attenuating structure.

As discussed, the lattice may terminate into the posterior surface of the shell along the outer regions of the shell (e.g., within the medial portion and the lateral portion). However, it is contemplated that the corresponding channels may extend beyond (in the direction of the outer regions) of the impact attenuating structure. The extensions of the channels to a greater extent than the corresponding lattice portions may provide additional benefits. For example, it is contemplated that the channels provide ventilation between the impact attenuating structure and the wearer. Therefore, to fully ventilate moisture and air, it is contemplated that one or more channels may extend to the perimeter of the impact attenuating structure.

While not depicted, it is contemplated that a rib forming the lattice of a shell has a corresponding channel located on the impact attenuating structure in a location that aligns with the rib when the shell and the impact attenuating structure are coupled together. Additionally, it is contemplated that one or more channels may be included in the impact attenuating structures that do not correspond with a rib of the shell lattice. The non-associated channels may provide weight savings, additional ventilation, flexibility, and improved fit.

Further, it is contemplated that channels proximate the medial portion of a shell may have a smaller depth (recessed amount) than those channels proximate the lateral portion of the shell. In an exemplary aspect, the posterior surface of the medial portion of the impact attenuating structure is positioned on a tibia of a wearer when in an as-worn position. As such, it is contemplated that a greater volume of impact attenuating material proximate the tibia provides a better attenuation. Similarly, those channels on the lateral portion of the impact attenuating structure that are in more contact with muscle and flesh (non bone structures) may not require as much impact attenuating material and therefore a reduction in weight and improved ventilation characteristics may be achieved with a deeper (greater recessed) channel in that portion.

The impact attenuating structure 400 may be formed from any material suitable for an impact attenuating structure. For example, it is contemplated that a foam material may be utilized. Further, it is contemplated that a laminate material having an outer layer (e.g., a "skin") may surround a foam core. In an exemplary aspect, it is contemplated that the impact attenuating structure 400 is formed with an ethylene-vinyl acetate material. However, as previously discussed, it is contemplated that any suitable material for an impact attenuating structure may be implemented.

FIG. 4 illustrates a cutline 5-5 that extends horizontally in a medial to lateral direction through the impact attenuating structure 400. The cutline 5-5 is a reference line for the aspects illustrated in the cross-sectional view of FIG. 5.

Figure 5:
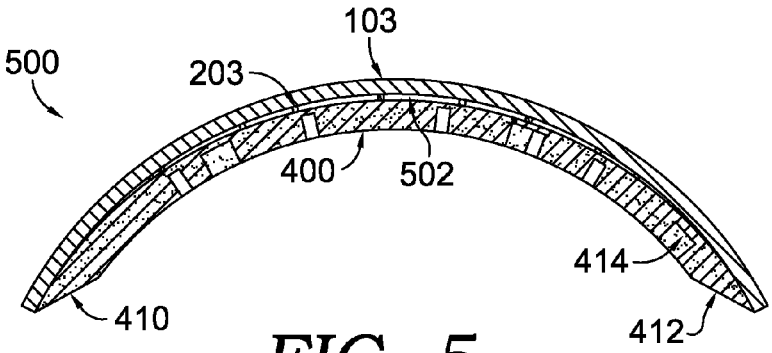
FIG. 5 illustrates a cross-sectional view of a protective apparatus comprised of the impact attenuating structure in FIG. 4 along cutline 5-5, in accordance with aspects of the present invention.

FIG. 5 is a cross-section view of a protective apparatus 500 comprised of the impact attenuating structure 400 of FIG. 4, in accordance with aspects of the present invention. The protective apparatus is further comprised of a shell 103 having a lattice 203. The lattice 203 creates an offset 502 between a posterior surface of the shell 103 and an anterior surface of the impact attenuating structure 400, in one or more locations.

The impact attenuating structure 400 is comprised of the medial edge 410 and the lateral edge 412. The impact attenuating structure 400 is further comprised of a channel 414 (and other channels not individually identified). As depicted in FIG. 5, the impact attenuating structure 400 is contacting the posterior surface of the shell 103 proximate the medial edge 410 and the lateral edge 412. In an exemplary aspect, it is contemplated that an adhesive (e.g., glue, epoxy, tape) is applied in the medial and lateral portions of the shell between the respective edges and the termination of the lattice. As a result, the posterior surface of the shell and the anterior surface of the impact attenuating structure are coupled together. In an exemplary aspect, the anterior surface of the impact attenuating structure is not permanently couple with a protrusion surface of the lattice. Further, it is contemplated that the anterior surface of the impact attenuating structure is coupled with the posterior surface of the shell only in locations in which there is an obscured portion of an otherwise transparent shell. For example, a medial affixing location may be defined as a location proximate the medial edge that is suitable for affixing the shell and the impact attenuating structure together. Similarly, a lateral affixing location may be defined as a location proximate the lateral edge that is suitable for affixing the shell and the impact attenuating structure together.

The offset 502 represents a distance of separation between the anterior surface of the impact attenuating structure 400 and the posterior surface of the shell 103. In an exemplary aspect, the offset 502 correlates to a protrusion height of the lattice from the posterior surface of the shell 103. Therefore, as will be discussed in greater detail with respect to FIGS. 6-8 hereinafter, it is contemplate that the offset is greater in the middle portion of the shell 103 than the more medial and/or lateral portions of the shell 103.

Figure 6:
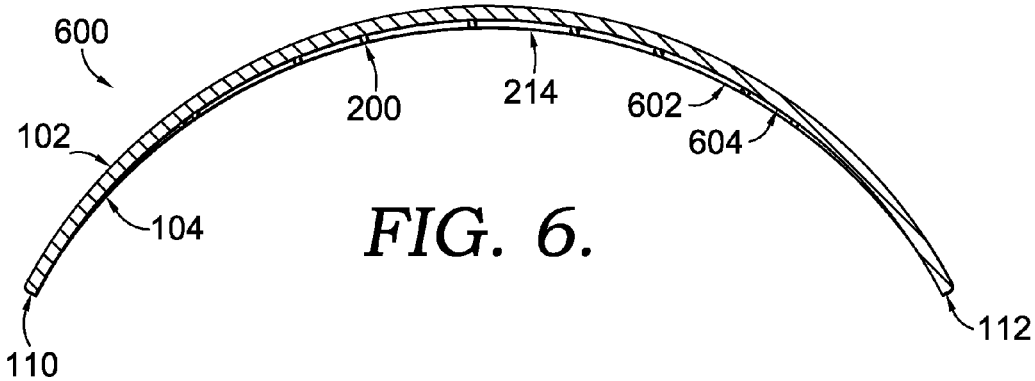
FIG. 6 illustrates a cross-sectional view of the shell in FIG. 2 along the cutline 6-6, in accordance with aspects of the present invention.

FIG. 6 is a cross-sectional view 600 of the shell 101 of FIG. 2 along the cutline 6-6, in accordance with aspects of the present invention. As previously discussed, the shell 101 is comprised of the medial edge 110, the lateral edge 112, the anterior surface 102, the posterior surface 104, the lattice 200, and the protrusion surface 214.

As discussed herein, it is contemplated that the protrusion surface 214 merges into the posterior surface 104, in an exemplary aspect. One method of merging in a predictable and eventual manner is achieved by having a general curve of the shell posterior surface 104 having a first diameter that is smaller than a general curve of the lattice protrusion surface 214. The general curve defining the posterior surface 104 has an approximate curve of 604 and the general curve defining the protrusion surface of the lattice has an approximate curve 602. For example, if the lattice curve 602 and the shell curve 604 have centers on a common axis that extends normal to the shell posterior surface 104 in the posterior direction from a middle position (medial to lateral) of the shell, when the shell curve 604 is of a smaller diameter than the lattice curve 602 and the lattice curve is more posterior at the point of the centerline axis extending from the shell, the further the lattice curve 602 extends in the medial to lateral direction from the centerline axis, the closer the lattice curve 602 will come to intercepting the shell curve 604. Stated differently, when the lattice curve 602 is larger than the shell curve 604, the lattice curve 602 will eventually intercept the shell curve 604. This interception in a three-dimensional space provides a merger of the two surfaces.

The additional lattice material (resulting in a greater offset) in the middle portion provide additional structural support in a region that is more likely to experience an impact force. Further, the raised lattice in the middle portion also provides a better distribution of a middle impact force across the width of the shell. Additionally, as less structural distribution is needed at the medial and lateral edges, a weight savings may be gained by limiting the material utilized in a lattice in those regions. Therefore, the varied offset created by the lattice across the width of the shell provides functional advantages that would not be gained by a constant offset, in an exemplary aspect.

Figure 7:
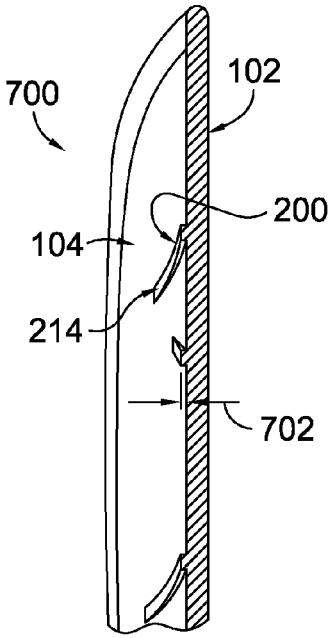
FIG. 7 illustrates a cross-section view of the shell in FIG. 2 along the cutline 7-7, in accordance with aspects of the present invention.

FIG. 7 is a cross-sectional view 700 of the shell 101 of FIG. 2 along the cutline 7-7, in accordance with aspects of the present invention. As previously discussed, the shell 101 is comprised of a posterior surface 104, an anterior surface 102, and a lattice 200. The lattice 200 forms the protrusion surface 214 that extends away in a posterior direction from the posterior surface 104. At the cutline 7-7, the protrusion surface 214 protrudes a first amount 702 from the posterior surface. The first amount 702 will be compared to a second amount 802 that will be discussed with respect to FIG. 8.

Figure 8:
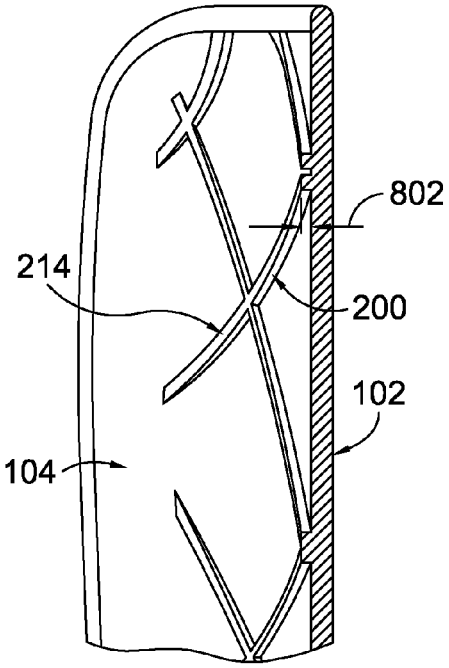
FIG. 8 illustrates a cross-sectional view of the shell in FIG. 2 along the cutline 8-8, in accordance with aspects of the present invention.

FIG. 8 is a cross-sectional view 800 of the shell 101 of FIG. 2 along the cutline 8-8, in accordance with aspects of the present invention. As previously discussed, the shell 101 is comprised of a posterior surface 104, an anterior surface 102, and a lattice 200. The lattice 200 forms the protrusion surface 214 that extends away in a posterior direction from the posterior surface 104. At the cutline 8-8, the protrusion surface 214 protrudes a second amount 802 from the posterior surface.

The first amount 702 of FIG. 7 is less than the second amount 802 of FIG. 8. The cutline 7-7 is closer to the medial edge than the cutline 8-8 on FIG. 2; therefore, in an exemplary aspect, the lattice is closer to intersecting the posterior surface 104 proximate the cutline 7-7 than at the cutline 8-8. Stated differently, the first amount 702 of FIG. 7 is smaller than the second amount 802 of FIG. 8 because the lattice structure is merging into the posterior surface 104 as the lattice extends towards the medial edge. In one aspect, the lattice includes one or more ribs, at least one of the ribs including a medial-edge portion and a middle portion, the medial-edge portion being closer to the medial edge than the middle portion, the medial-edge portion having a first rib height and the middle portion having a second rib height, and the first rib height being shorter than the second rib height.

While the concepts provided herein discuss the concept of a protection apparatus and depict a shin guard in particular, it is contemplated that this concept extends to all types of force attenuation applications. Additionally, the term "proximate" has been used herein. Proximate is a spatial term that is intended to reflect a locational sense of being close to, near, approximately at, and the like.

The invention claimed is:

1. A protective apparatus comprising:

an impact shell having an anterior surface, an opposite posterior surface, a medial edge, an opposite lateral edge, a superior edge, and an opposite inferior edge;

the impact shell further comprising an integrally formed structural lattice protruding from the impact shell posterior surface forming a protrusion surface;

the lattice including one or more ribs, at least one of the ribs including a medial-edge portion and a middle portion, wherein the medial-edge portion is closer to the medial edge than the middle portion, the medial-edge portion having a first rib height and the middle portion having a second rib height, the first rib height being shorter than the second rib height; and an impact attenuating structure covering at least a portion of the posterior surface of the impact shell and the protrusion surface of the lattice, such that the integrally formed structural lattice is layered between the impact attenuating structure and the impact shell, the impact attenuating structure affixed to the impact shell at least proximate the medial edge and the lateral edge.

2. The protective apparatus of claim 1, wherein the impact shell is formed from at least one material selected from the following:

a) a polypropylene material;

b) a styrene-butadiene copolymer material; or c) a carbon fiber-based material.

3. The protective apparatus of claim 1, wherein the lattice is comprised of at least one first linear extending from an inferior medial location to a superior lateral location of the impact shell and at least one second linear extending from an inferior lateral location to a superior medial location of the impact shell, such that the at least one first linear rib and the at least one second linear rib intersect.

4. The protective apparatus of claim 3, wherein the at least one first linear rib and the at least one second linear rib protrude from the posterior surface a common amount at a common location of the posterior surface.

5. The protective apparatus of claim 3, wherein the at least one first linear rib and the at least one second linear rib extend closer to the medial edge than the lateral edge.

6. The protective apparatus of claim 1, wherein the second rib height is taller than any other rib height of the at least one of the ribs.

7. The protective apparatus of claim 1, wherein the protrusion surface of the lattice extends from the superior edge to the inferior edge.

8. The protective apparatus of claim 1, wherein the protrusion surface of the lattice does not extend to the medial edge or the lateral edge of the impact shell.

9. The protective apparatus of claim 1, wherein the impact attenuating structure is affixed to the posterior surface of the impact shell within a medial affixing portion of the posterior surface and a lateral affixing portion of the posterior surface, the medial affixing portion extending between the medial edge and a most medial protrusion of the lattice and the lateral affixing portion extending between the lateral edge and a most lateral protrusion of the lattice.

10. The protective apparatus of claim 1, wherein the lattice is visually perceptible through the anterior surface of the impact shell.

11. The protective apparatus of claim 1, wherein the impact attenuating structure is comprised of a posterior surface and an anterior surface, the impact attenuating structure anterior surface is proximate the impact shell posterior surface and the lattice protrusion surface.

12. The protective apparatus of claim 11, wherein the impact attenuating structure anterior surface is offset from the impact shell posterior surface by the lattice.

13. A protective apparatus comprising:

an impact shell having an anterior surface and an opposite posterior surface and a medial edge, an opposite lateral edge, a superior edge, and an opposite inferior edge, the posterior surface of the impact shell having a first curve extending outwardly in a direction of the anterior surface, the first curve extending normal to the posterior surface between the superior edge and the opposite inferior edge, the first curve extending from the medial edge to the lateral edge, the first curve having a first arc radius based on a first arc extending from the medial edge to the lateral edge;

a structural lattice integrally formed with the impact shell and protruding from the posterior surface of the impact shell, the structural lattice being comprised of a plurality of interconnected rib members protruding from the posterior surface in a direction opposite from the anterior surface, the plurality of interconnected rib members forming a protrusion surface;

the protrusion surface having a second curve extending outwardly in a direction of the impact shell anterior surface, the second curve also extending normal to the posterior surface and sharing a common centerline axis with said first curve; the second curve having a second arc radius based on a second arc, wherein the second arc radius is greater than the first arc radius; and an impact attenuating structure positioned across at least a portion of the posterior surface of the impact shell and the protrusion surface of the lattice, such that the lattice is layered between the impact attenuating structure and the impact shell.

14. The protective apparatus of claim 13, wherein the structural lattice protrudes a greater amount between a medial location of the structural lattice and a lateral location of the structural lattice than at the medial location or the lateral location.

15. The protective apparatus of claim 13, wherein the impact attenuating structure is a foam-based material.

16. The protective apparatus of claim 13, wherein the impact attenuating structure is comprised of a posterior surface and an anterior surface, the anterior surface proximate the impact shell posterior surface, the impact attenuating structure comprised of a plurality of channels.

17. The protective apparatus of claim 13, wherein a portion of the plurality of channels on the posterior surface of the impact attenuating structure aligns with a portion of the plurality of rib members of the lattice.

18. The protective apparatus of claim 13, wherein a medial portion of the plurality of channels indent from the impact attenuating structure posterior surface a lesser amount than a lateral portion of the plurality of channels.

* * * * *